United States Patent [19]

Adleman et al.

[11] Patent Number: 4,724,616

[45] Date of Patent: Feb. 16, 1988

[54] PANEL PUNCH

[76] Inventors: Larry G. Adleman, 1307 E. Gate Pkwy.; George P. Gill, 1327 16th Ave., both of Rockford, Ill. 61108

[21] Appl. No.: 880,842

[22] Filed: Jun. 30, 1986

[51] Int. Cl.[4] ..... B26F 1/00

[52] U.S. Cl. ..... 30/360; 30/361

[58] Field of Search ..... 30/358, 360, 361, 229

[56] References Cited

U.S. PATENT DOCUMENTS

| | | | |
|---|---|---|---|
| 1,721,007 | 7/1929 | Doherty | 30/360 |
| 2,830,662 | 4/1958 | Marcum | 30/358 |
| 4,087,913 | 5/1978 | Jackson | 30/360 |
| 4,481,700 | 11/1984 | Redmon | 30/360 |

FOREIGN PATENT DOCUMENTS

| | | | |
|---|---|---|---|
| 851760 | 10/1939 | France | 30/360 |

*Primary Examiner*—Paul A. Bell

*Assistant Examiner*—Michael D. Folkerts

*Attorney, Agent, or Firm*—Lackenbach Siegel Marzullo & Aronson

[57] ABSTRACT

The panel punch includes a main punch configured to punch a trapezoidal opening in an electrical panel to receive an electrical chassis connector and a secondary punch integral with the main punch and extending from opposite ends thereof configured to punch a U-shaped slot in the panel extending from the ends of the trapezoidal opening to receive mounting screws for physically attaching the electrical connector to the panel.

8 Claims, 7 Drawing Figures

PANEL PUNCH

FIELD OF THE INVENTION

The invention relates to punch and die constructions and, in particular, to punch and die constructions for punching holes in panels to receive electrical chassis connectors.

BACKGROUND OF THE INVENTION

U.S. Pat. No. 4,481,700 issued Nov. 13, 1984, to Larry Redmon illustrates a panel punch and die set wherein the punch and die are connected together on opposite sides of a panel by a plurality of threaded bolts. A plurality of holes to receive the bolts must be drilled in the panel first, however. The punch and die are configured to punch a generally trapezoidal hole in the panel to receive the main body of the electrical chassis connector. However, holes for mounting screws to actually mount the connector on the panel must be drilled in separate operations following the punching operation.

A panel punch and die set that requires drilling of only one pilot hole for a draw stud extending between the punch and die is illustrated in the Greenlee Tool Company catalog August, 1985 at p. 102 and designated RS-232 panel punch. The punch shown carries a portion to punch the trapezoidal opening in the panel and also carries a pair of lateral small round punch inserts releasably attached to the punch body, one on each side of the trapezoidal opening and separate therefrom, to punch a pair of circular holes, separate from the trapezoidal opening, in the panel for receiving the mounting screws for mounting the electrical connector on the panel.

Although the panel punch shown in the catalog performs satisfactorily in service, there is a need to reduce substantially the amount of force required to effect punching with that punch and die set.

SUMMARY OF THE INVENTION

The invention contemplates a panel punch having a main or primary punch for punching a trapezoidal or other opening for receiving an article or component, such as an electrical connector, and a secondary punch on opposite ends of the main punch for punching narrow slots intersecting with and extending from the trapezoidal or other opening for receiving mounting means for the component, such as an electrical connector, to be positioned in the opening. Preferably, the secondary punches are integral with and extend from the main punch.

The invention also contemplates a mating die for the panel punch with the die having a main cavity to receive the main punch with clearance and a secondary narrow slot-like cavity on opposite ends of the main cavity to receive the secondary punches with clearance.

The invention further contemplates a panel punch of the type described hereinabove wherein the configuration of the secondary punch is blended with that of the main punch to produce a substantial reduction in force required to force the punch through the panel.

DESCRIPTION OF PREFERRED EMBODIMENTS

Figure 1:
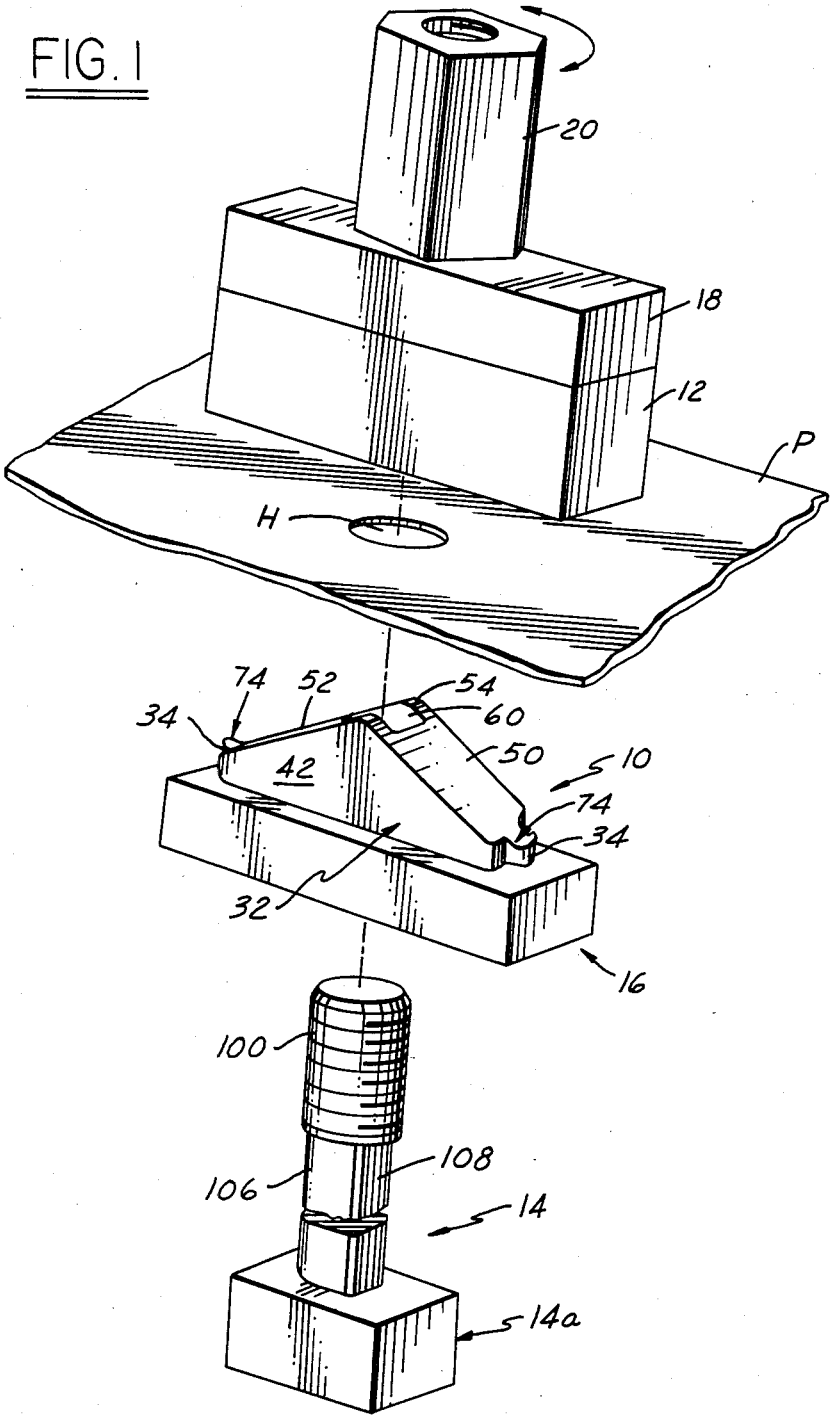
FIG. 1 is a perspective exploded view of the punch and die of the invention.
Figure 2:
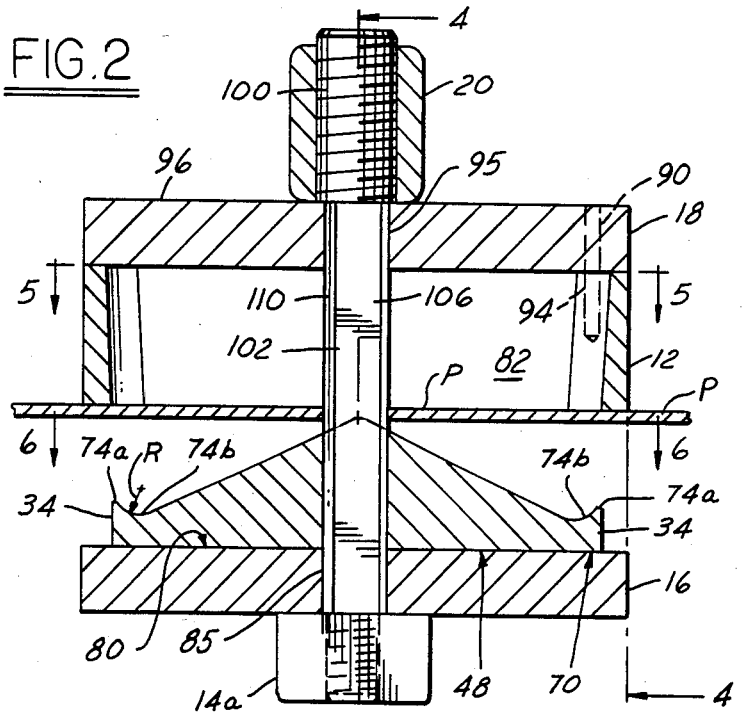
FIG. 2 is a partial cross-sectional view of the assembled punch and die assembly before penetration of the punch into the workpiece.
Figure 3:
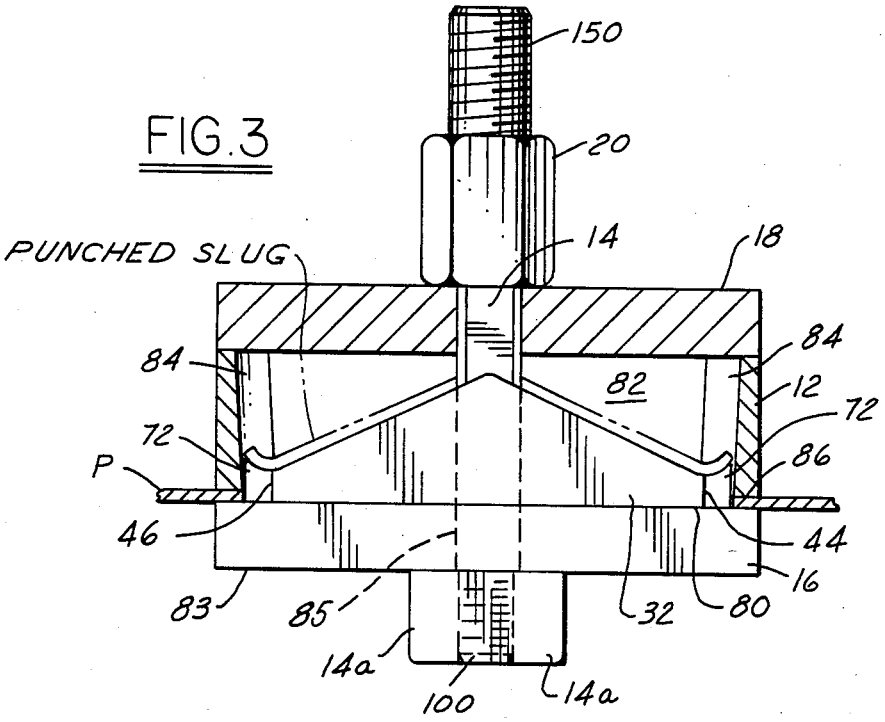
FIG. 3 is similar to FIG. 2 after punch penetration.

FIG. 1 illustrates a punch and die set of the invention having a punch 10, die 12, draw stud 14 with enlarged head **14*a*, punch follow plate 16, die alignment plate 18 and nut 20. A section of panel P to be punched is shown between the punch and die and includes a pilot hole H of a size to receive the draw stud. As shown in FIGS. 2–3**, the punch and die are assembled in working relation on opposite sides of the panel in known fashion with the punch ultimately received in the die after the opening is punched.

Figure 7:
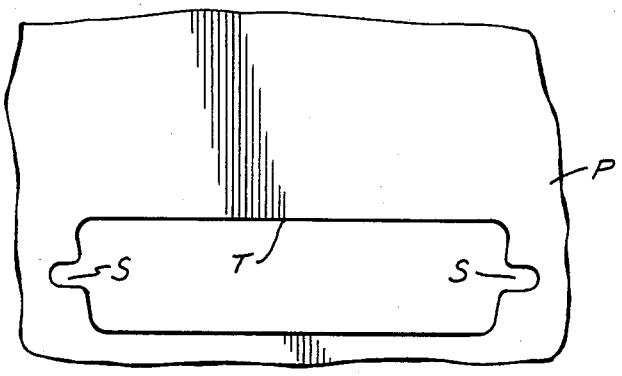
FIG. 7 is a plan view of the punched panel.

The punch 10 includes a main punch 32 configured as shown to punch a general trapezoidal opening T in panel P, and includes secondary punches 34 extending from opposite ends of the main punch 32 to punch generally U-shaped slots S intersecting with and extending from opposite ends of the trapezoidal opening, FIG. 7.

Figure 4:
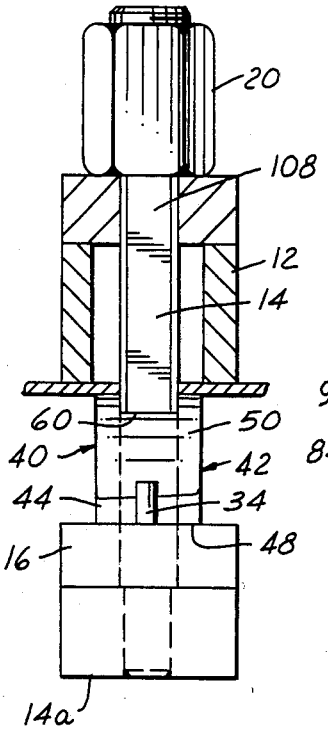
FIG. 4 is a partial end elevation of FIG. 3 in the direction of arrows 4—4 in FIG. 2.
Figure 5:
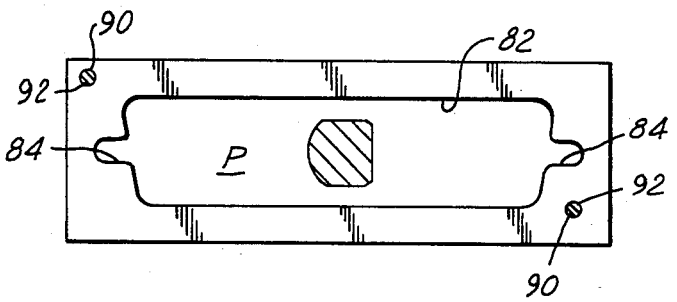
FIG. 5 is a view of the die taken along line 5—5 of FIG. 2.

In particular, the main punch 32 includes lateral working surfaces 40,42 tapering slightly toward one another toward the surface 48 (FIG. 4) and with surface 40 shorter in length than surface 42 to provide the trapezoidal profile. The lateral working surfaces 40,42 are connected at opposite ends by end working surfaces 44,46 which taper toward one another from lateral working surface 42 toward lateral working surface 40 and from which the secondary punches 34 extend.

Flat surface 48 interconnects working surfaces 40,42,44, 46 on a side of the punch facing away from the die 12 when assembled. Inclined working surfaces 50,52 and flat, narrow working surface 54 are provided on the opposite side of the punch from surface 48. Inclined working surfaces 50,52 extend from flat working surface 54 in outwardly diverging relation toward the ends of the main punch and at equal angles relative thereto; e.g. about $24\frac{1}{2}°$ relative to the plane of working surface 54 until they intersect the respective end working surfaces 44,46. Of course, inclined working surfaces 50,52 also intersect the parallel lateral working surfaces 40,42 as shown.

Figure 6:
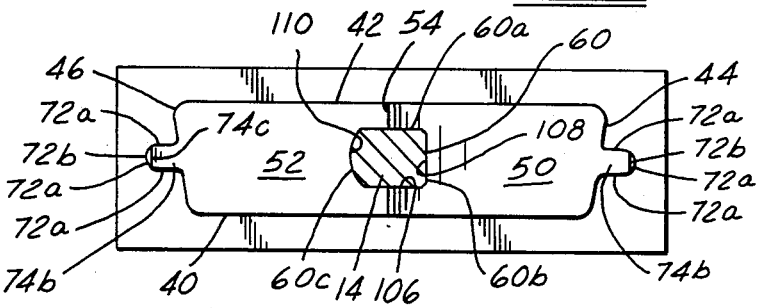
FIG. 6 is a sectional view taken along lines 6—6 of FIG. 2.

A bore or slot 60 extends from surface 48 to flat working surface 54 of the punch to receive the draw stud 14 when the punch and die are assembled in working relation on opposite sides of panel P. To this end, the profile or cross-section of slot 60 is complementary to that of the draw stud but slightly larger in dimension to provide a controlled clearance therebetween. The slot 60 has parallel sides **60*a* connected by planar side 60*b* and arcuate side 60*c* as shown in FIG. 6** to provide a D-shaped type slot profile so that the draw stud can only be inserted in one way therethrough.

Secondary punches 34 are integral with the main punch 32 and extend laterally in opposite directions from respective end working surfaces 44,46. Each secondary punch 34 includes a surface 70 extending from surface 48 of the main punch 32. Each secondary punch 32 also includes a working surface 72 extending from the respective end working surface 44,46 and comprising planar lateral working surfaces 72*a* and radial end working surface 72*b* interconnecting the planar lateral surfaces 72*a* as shown in FIG. 6. Radial surfaces 72*b* incline or taper toward one another and toward surface 70 as shown best in FIG. 2. Planar working surfaces 72*a* converge or taper toward one another slightly in the direction toward surface 70.

Facing opposite from surface 70 is working surface 74 on each secondary punch 34. Each working surface 74 includes an outer working flat 74*a* and arcuate or radial working surface 74*b* extending from the flat 74*a* at line of intersection 74*c* to and blended into the respective diverging inclined working surface 50,52 on that end. Radial working surface 74*b* is defined by radius R and extends into the respective inclined working surface as shown. It is apparent that arcuate working surface 74*b* of each secondary punch provides an arcuate concave (relative to side 70) recess between the flat working surface 74*a* and adjacent respective inclined working surface 50,52. Each arcuate recess faces away from surface 70 toward the panel to be punched. In FIG. 2, it is clear that the height of flat working surface 74*a* is less than the maximum height of inclined working surfaces 50,52 adjacent central flat working surface 54.

The taper or convergence provided on the various working surfaces of the punch as well as the die function to aid in stripping the punched slug from the punch.

As shown in FIGS. 2–5 the die 12 includes a main cavity 82 complementary in shape to the outer lateral profile of main punch 32 and secondary cavities 84 extending laterally from opposite sides of the main cavity and complementary in shape to the outer lateral profile of the respective secondary punches 34, except that the cavities 82,84 are slightly larger in outer lateral or profile dimension so that the punches 32,34 can be received with slight clearance therein during the punching operation. Outer lateral profile refers to the lateral and end working surfaces of punches 32,34 described hereinabove.

The internal working surfaces of the die 12 are provided with tapers generally complementary to the tapers on the lateral side working surfaces of punches 32,34.

FIGS. 1–3 illustrate the punch follower plate 16 which is positioned with its side 80 against the punch surfaces 48,70 and includes a bore 85 shaped to receive the draw stud 14. The side 83 of the punch follower plate opposite side 80 thereof abuts draw stud head 14*a* when the punch and die set is assembled.

FIGS. 1–3 show the die alignment plate 18 which is fastened to the side of the die oppositely disposed from the side thereof which faces the punch and abuts the panel when assembled for punching. The die alignment plate 18 includes diagonally disposed bores 90 which receive machine screws 92 in turn threaded into threaded bores 94 in the die 12. Die alignment plate 18 includes a central bore 95 shaped to receive the draw stud 14. The side 96 of the die alignment plate abuts nut 20 on the draw stud when the punch and die is assembled.

Draw stud 14 is shown in FIGS. 1–3 and includes opposite threaded ends 100 on which nut 20 and draw stud head 14*a* are threaded as described hereinabove. An intermediate portion 102 is unthreaded. As mentioned hereinabove, the draw stud has a cross-sectional profile comprising parallel planar sides 106 interconnected by planar side 108 and arcuate side 110 to define a general D-type profile so that the draw stud can be positioned in the bores of the punch, die, punch follower plate and die alignment plate in only one way.

A punch and die set as described hereinabove has exhibited about a 25% reduction in the amount of force required to effect pucnhing as compared to the force required for punching the same panel or material with the prior art punch RS-232 referred to hereinabove with no sacrifice in the quality of punched hole or opening produced.

The substantial reduction in required punching force is largely due to the integration of the main punch 32 and secondary punches 34 into a unitary punch and to the blending and configuration of the working punch surfaces with and relative to one another.

To effect punching once the punch and die set is assembled, the nut 20 is turned on the draw stud by a wrench to cause the punch to penetrate into the panel and ultimately into the die as is known. The punch and die set described can also be driven with other devices, such as ball screw drivers and hydroram drivers, known in the art.

While certain specific and preferred embodiments of the invention have been described in detail hereinabove, those skilled in the art will recognize that various modifications and changes can be made therein within the scope of the appended claims which are intended to include equivalents of such embodiments.

We claim:

1. A punch for punching an opening in a panel for an article comprising:

a main punch having ends and a side and a pair of inclined working surfaces spaced from said side, said working surfaces each extending toward said side to a respective end of said main punch in diverging relation to one another and configured to punch said opening in the panel for receiving the article;

at least one secondary punch having a working surface for punching a secondary opening intersecting with and extending from said opening for receiving the article for receiving mounting means for attaching said article to the panel, said at least one secondary punch extending from one said respective end of the main punch and terminating in a remote secondary punch end, said at least one secondary punch having said working surface integrally interconnecting and blended with the adjacent inclined working surface of said main punch, the maximum height of said secondary punch working surface relative to said side being less than the maximum height of said inclined working surfaces and not less than the minimum height of said inclined working surfaces relative to said side.

2. The punch of claim 1, wherein the main punch is configured to punch a shaped opening in the panel and said at least one secondary punch is configured to punch a U-shaped slot in the panel extending from the shaped opening.

3. The punch of claim 1 wherein the main punch includes a central working flat and the diverging inclined working surfaces each extend from the working flat to a repsective end of the main punch, said secondary punch working surface includes an arcuate working surface extending toward said main punch and blended with the associated inclined working surface at said main punch end.

4. The punch of claim 3 wherein said at least one secondary punch includes a working flat on the remote secondary punch end, and the arcuate working surface extends between the working flat to the associated surface of the main punch.

5. The punch of claim 3 wherein the arcuate working surface is a circular arc surface extending into the adjacent inclined working surface and defining a recess on the secondary punch, the recess facing the panel to be punched.

6. The punch of claim 1 which further includes a shaped bore configured to receive a draw stud operatively connecting the punch with a die.

7. The punch of claim 6 where the shaped bore has a D-shaped cross-sectional profile.

8. The punch of claim 1 combined with a die having a main cavity to receive the main punch and a secondary cavity extending from the main cavity to receive a secondary punch.

* * * * *